United States Patent [19]

Bradshaw et al.

[11] Patent Number: 4,792,796

[45] Date of Patent: Dec. 20, 1988

[54] ELECTRONIC ALARM APPARATUS

[75] Inventors: Leroy Bradshaw, Hamilton; John B. Henson, Thornhill; Paul I. Waterhouse, Lynden, all of Canada

[73] Assignee: R.J.S. Security & Tracking Systems Corporation, Toronto, Canada

[21] Appl. No.: 13,025

[22] Filed: Feb. 10, 1987

[30] Foreign Application Priority Data

Nov. 20, 1986 [CA] Canada ..... 523462

[51] Int. Cl.[4] ..... G08B 1/08

[52] U.S. Cl. ..... 340/539; 340/531; 340/551; 340/573; 455/9; 455/41; 455/229

[58] Field of Search ..... 340/539, 531, 551, 568, 340/573, 693; 455/41, 9, 229, 134, 228

[56] References Cited

U.S. PATENT DOCUMENTS

| | | | |
|---|---|---|---|
| 3,336,530 | 8/1967 | Sloan et al. | 340/539 |
| 4,021,807 | 5/1977 | Culpepper et al. | 343/112 R |
| 4,101,872 | 7/1978 | Pappas | 340/539 |
| 4,136,338 | 1/1979 | Antenore | 340/531 |
| 4,162,448 | 7/1979 | Gilmour, deceased | 340/539 |
| 4,236,068 | 11/1980 | Walton | 235/380 |
| 4,305,143 | 12/1981 | Simms | 367/134 |
| 4,337,462 | 6/1982 | Lemelson | 340/539 |
| 4,442,426 | 4/1984 | Heuschmann et al. | 340/539 |
| 4,523,184 | 6/1985 | Abel | 340/539 |
| 4,556,883 | 12/1985 | Strietzel | 340/825.54 |
| 4,593,273 | 6/1986 | Narcisse | 340/572 |

*Primary Examiner*—Donnie L. Crosland
*Attorney, Agent, or Firm*—Weldon F. Green

[57] ABSTRACT

In electronic alarm apparatus for monitoring the presence or absence of objects within a given area, a transmitter attachable to an object, a shift register for storing a digital identification code, and an electronic circuit including a time delay circuit for periodically transmitting the digital identification code as a radio frequency signal; a monitor including a logic timing circuit for activating a receiver for receiving the radio frequency signal, a check circuit for comparing the received signal with a stored identification code and audio logic circuit and liquid crystal display for providing audio and visual indications upon failure of receiving a given number of consecutive transmissions from a given transmitter; the transmitter further including tamper switch and tamper flag logic circuit for changing the digital identification code stored in the shift register upon premature removal of the transmitter from the object.

21 Claims, 3 Drawing Sheets

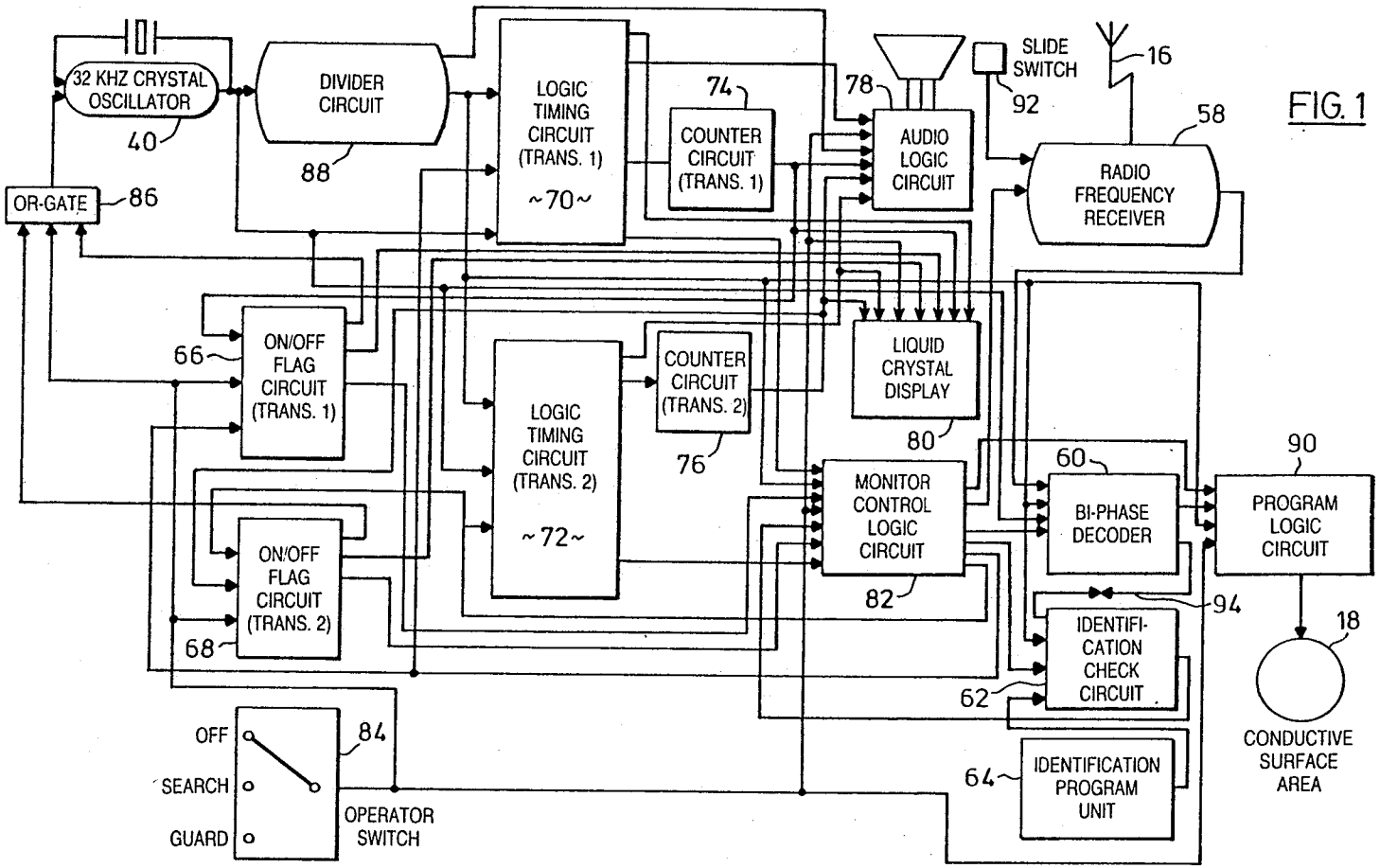
FIG. 1
PROGRAM LOGIC CIRCUIT
90
18
CONDUCTIVE SURFACE AREA
94
RADIO FREQUENCY RECEIVER
58
16
BI-PHASE DECODER
60
IDENTIFI-CATION CHECK CIRCUIT
IDENTIFICATION PROGRAM UNIT
SLIDE SWITCH
92
62
64
AUDIO LOGIC CIRCUIT
78
LIQUID CRYSTAL DISPLAY
80
MONITOR CONTROL LOGIC CIRCUIT
82
COUNTER CIRCUIT (TRANS. 1)
74
COUNTER CIRCUIT (TRANS. 2)
76
LOGIC TIMING CIRCUIT (TRANS. 1)
~70~
LOGIC TIMING CIRCUIT (TRANS. 2)
~72~
DIVIDER CIRCUIT
88
ON/OFF FLAG CIRCUIT (TRANS. 1)
66
ON/OFF FLAG CIRCUIT (TRANS. 2)
68
OPERATOR SWITCH
84
OFF
SEARCH
GUARD
32 KHZ CRYSTAL OSCILLATOR
40
OR-GATE
86

ELECTRONIC ALARM APPARATUS

FIELD OF THE INVENTION

This invention relates to improvements in electronic alarm apparatus comprised of a monitor, for receiving a radio frequency signal, and at least one transmitter, for periodically emitting a radio frequency signal, the monitor including means for receiving a radio frequency signal from a transmitter and means for providing visual and audio alarms upon absence of reception of a given number of consecutive signals.

Particularly, this invention relates to improvements in electronic alarm apparatus wherein each transmitter associated with a given monitor transmits a unique identification code so as to permit operation in overlapping areas with a further monitor and its associated transmitters.

More particularly, the monitor energizes and codes each transmitter with a unique identification code so that a transmitter, once programmed, becomes associated with that monitor.

Moreover, this invention relates to improvements in electronic alarm apparatus wherein the monitor distinguishes between reception of a radio frequency signal from one of its associated programmed transmitters from that of another, and conversely, provides visual and audio alarms upon absence of a given number of consecutive signals for that transmitter.

Further, this invention relates to improvements in an electronic alarm apparatus wherein the monitor is capable of selectively setting the range to define an area within which successful reception of a signal from the transmitters is received; the monitor providing appropriate visual and audio alarms upon moving a transmitter outside the area.

BACKGROUND TO THE INVENTION

Systems of the type under consideration normally comprise miniature electronic apparatus for determining the relative direction of a remote source of radio transmissions or comprise perimeter alarm apparatus including a loop of wire to be placed around an area to be guarded and electronic circuitry to be connected with the loop of wire for detecting a signal imposed on the loop from a remote transmitter.

One example of miniaturized electronic apparatus for determining the relative direction to a remote source of radio transmissions is U.S. Pat. No. 3,336,530.

This patent discloses a radio transmitter/receiver tracking system using modulated radio transmissions to provide information of the activity at the location of a remote radio transmitting source, and includes a directional antenna to determine the general direction from which the radio transmissions are being received.

U.S. Pat. No. 4,136,338, discloses a transmitter/monitor system which signals an alarm when the transmitter is moved outside a given boundary. The boundary comprises a loop of wire placed around an area to be guarded and electronic circuitry connected to the wire loop for detecting signals imposed on the loop. A transmitter within the bounded area provides the signal imposed on the loop. Once the transmitter no longer imposes the signal on the loop, the alarm circuitry is energized and an alarm sounds.

In this prior art alternative the transmitter includes a sequencer in connection with three oscillators which alternately energizes coils to create magnetic flux lines.

The monitor includes a perimeter loop connected with a bandpass filter and amplifier circuit which is connected to a frequency and level detector which operates a time delay circuit to energize an alarm when the necessary signal is absent for a predetermined period of time.

The perimeter loop and the transmitter are coupled by magnetic induction, upon energization of the coils.

OBJECTS OF THE INVENTION

It is an object of this invention to provide improved apparatus comprised of at least one transmitter, for periodically emitting a radio frequency signal, and a monitor, for receiving the radio frequency signal and for providing visual and audio alarms upon absence of reception of a given number of consecutive signals.

It is an object of this invention to provide the monitor with means for identifying a signal sent from one of its corresponding transmitters so that operation in overlapping areas with further monitors and their corresponding transmitters is permitted.

Particularly, it is an object of this invention to provide improved apparatus wherein each transmitter is coded by the monitor so that the transmitter becomes associated with that monitor.

More particularly, it is an object of this invention that when a monitor turns on a transmitter, only that monitor unit is able to turn off that transmitter.

Further it is an object to have the monitor indicate successful reception of signals from remote transmitters and to provide, for a particular transmitter, appropriate audio, visual, or other like alarm after an absence of the corresponding signal over a given duration of time.

A further object of the invention is to provide improved apparatus for monitoring a transmitter attached to an object within a given area and so guard, as in the case of child security, children from a variety of potential hazards during those times when a child is not directly in view or when the parents attention is diverted.

Moreover, the improved apparatus achieves all of the above objects without requiring the use of complex gadgetry or physical boundary means, allowing easy use of same in a variety of locations and differing terrains—the set-up time involving the programming of the transmitters, only.

FEATURES OF THE INVENTION

It is a feature of the invention to provide improved apparatus for monitoring the presence or absence of a coded radio freqeuncy signal within a given area, the monitor including an electronic circuit for receiving the coded signal, and at least one transmitter associated with that monitor including electronic circuits for producing and transmitting the coded radio frequency signal. The monitor further includes an electronic circuit for verifying that the coded radio frequency signal received was transmitted from an associated transmitter and includes an electronic circuit and appropriate alarm for indicating failure of reception of the codes radio frequency signal.

Further, it is a feature of the invention to provide apparatus for monitoring the presence or absence of a coded radio frequency signal within a given area wherein a plurality of transmitters are associated with a given monitor. The monitor includes an electronic circuit for identifying which of the plurality of associated transmitters produced and transmitted the coded radio frequency signal.

More particularly, the plurality of associated transmitters produce and transmit the coded radio frequency signal periodically at spaced apart intervals to one another and the electronic circuit for identifying which of the plurality of associated transmitters produced and transmitted the coded radio frequency signal includes a logic timing circuit.

Moreover, it is a feature of the invention to provide the associated transmitters with a time delay circuit to produce and transmit the coded radio frequency signal periodically at spaced apart time intervals.

It is also a feature of this invention to have the monitor include a means for storing a coded signal. An electronic circuit including a check circuit is provided for comparing the coded radio frequency signal received with the coded signal stored.

It is a further feature of this invention to provide the monitor with an electronic circuit for transmitting the coded signal stored from the storing means of the monitor to the electronic circuit of the transmitter for producing the coded radio frequency signal.

Still further, it is a feature of this invention to provide the monitor with a counter circuit for counting successive failures of reception of the coded radio frequency signal, activating the alarm for indicating failure of reception of the coded radio frequency signal after a given number of counts.

Still further, it is a feature of this invention to provide apparatus for monitoring the presence or absence of at least one object within a given area. The transmitter associated with the monitor including a means for attachment to the object. The means for attaching the transmitter to the object including a tamper switch and logic circuit for altering the coded radio frequency signal produced and transmitted by the transmitter upon premature removal of the transmitter from the object.

It is still another feature of this invention to have the coded radio frequency signal transmitted include a digital identification code.

Further, the electronic circuit of the transmitter for producing the signal transmitted includes a shift register for storing the digitial identification code and outputting same to the electronic circuit for transmitting the coded radio frequency signal, and includes a logic circuit for recirculating the digital identification code outputted from the shift register back into the shift register. The electronic circuit for transmitting the coded radio frequency signal includes means for encoding and modulating the digital identification code for transmission.

Still further, the monitor includes an antenna and receiver, including means for demodulating and decoding the received digital identification code.

Moreover, the coded signal contained in the storing means of the monitor comprises a digital code substantially identical to the digital identification code stored in the shift register of the transmitter.

DESCRIPTION OF THE INVENTION

These and other objects and features will become apparent in the following description of the preferred embodiment of the invention to be read in conjunction with the accompanying sheets of drawings in which:

FIG. 1 is a block diagram of the monitor of the preferred embodiment;

Figure 4:
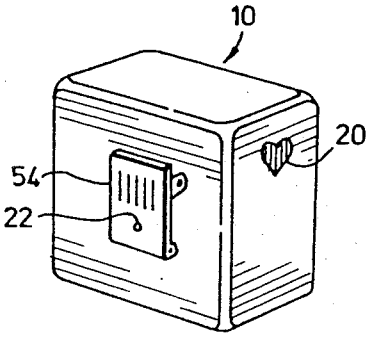
FIG. 4 is a perspective view of a sample transmitter of the preferred embodiment taken from a point to the right and upwardly of the rear face thereof.

According to the invention a typical alarm system of the type under consideration includes at least one transmitter, of which transmitter 10, illustrated in FIG. 4 is an example thereof, for periodically transmitting through internal antenna 12 a radio frequency signal at approximately 50 megahertz, and monitor 14, illustrated in FIG. 3, for receiving through antenna 16 the radio frequency signal and providing means, as hereinafter explained, for indicating successful reception of the signal from that transmitter, or conversely, identifying the absence of reception of a signal from a given transmitter.

Figure 3:
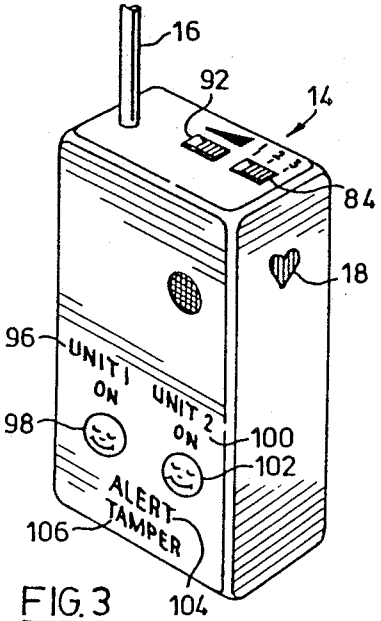
FIG. 3 is perspective view of a sample monitor of the preferred embodiment taken from a point to the right and upwardly of the front face thereof.

Monitor 14 presents on its outer surface, as best illustrated in FIG. 3, conductive surface area 18 which transmits through local capacitive coupling an identification code or other programming to corresponding conductive surface area 20 located on the outer surface of transmitter 10, as best illustrated in FIG. 4, when same are brought together in interactive engagement, as will be hereinafter explained.

Each transmitter 10 is programmed by corresponding monitor 14 with a digital programmming code consisting of 1 bit, used for synchronizing the periodic transmissions of transmitter 10 to the reception window of monitor 14, followed by 8 bits, 7 bits being the unique system identification code for that monitor/ transmitter(s) system, and the last bit being a zero, representing a tamper flag indicating if tamper switch 22 has been opened prematurely in removing transmitter 10 from an object, as will hereinafter be explained.

Figure 2:
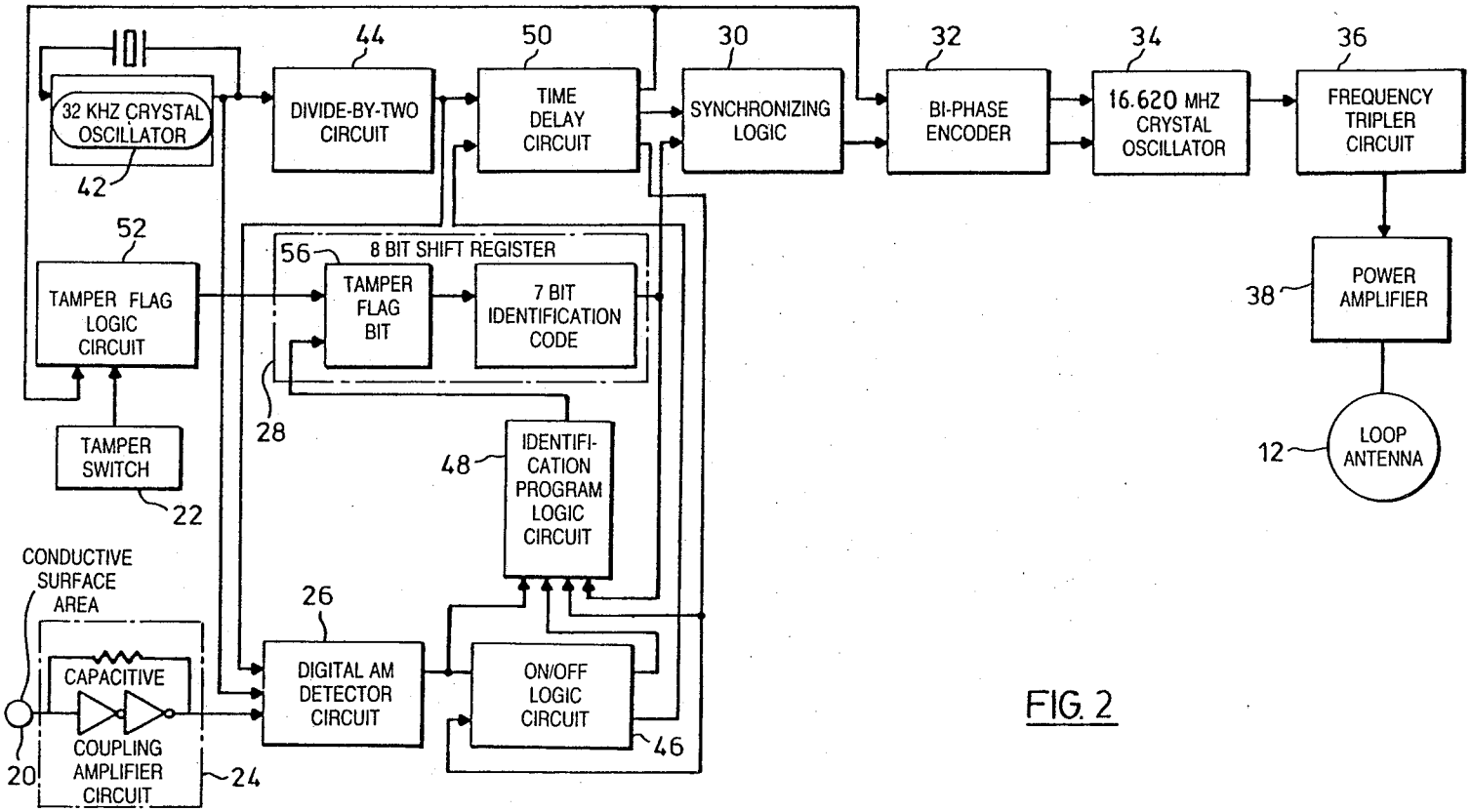
FIG. 2 is a block diagram of the transmitter of the preferred embodiment.

Transmitter 10, as best illustrated in FIG. 2, basically comprises means for detecting the programming code or other programming from monitor 14 through conductive surface area 20 including capacitive coupling amplifier circuit 24 and digital AM detector circuit 26, means for storing the unique 7 bit identification code and 1 bit tamper flag including 8 bit shift register 28, and means for recombining the output of 8 bit shift register 28 with the synchronizing code and transmitting same as a 50 megahertz radio frequency signal including synchronizing logic 30, for adding the synchronizing code to the output of 8 bit shift register 28, bi-phase encoder 32, 16.620 megahertz crystal oscillator 34, frequency tripler circuit 36, power amplifier 38, and antenna 12.

Transmitter 10 is programmed by monitor 14 with the programming code when conductive surface area 20 is brought into interactive engagement with conductive surface area 18 of monitor 14. Programming between monitor 14 and transmitter 10 occurs through local capacitive coupling; the signal received by conductive surface area 20 is amplified by capacitive coupling amplifier circuit 24 and sent to digital AM detector circuit 26. The programming from monitor 14, amplified by capacitive coupling amplifier circuit 24, is in the form of an amplitude modulated signal having a 32 kilohertz carrier generated by 32 kilohertz crystal oscillator 40 of monitor 14, as best illustrated in FIG. 1.

Transmitter 10 includes controlled low powered 32 kilohertz crystal oscillator 42 which continuously feeds divide-by-two circuit 44 reducing the frequency of 32 kilohertz crystal oscillator 42 to approximately 16 kilohertz.

The 32 kilohertz signal from crystal oscillator 42 is fed together with the 16 kilohertz signal from divide-by-two circuit 44 to digital AM detector circuit 26. Digital AM detector circuit 26 detects the 32 kilohertz programming signal counting transitions in the signal using flip-flops (not illustrated). This count for the detected signal is then compared to a similar count obtained from the 32 kilohertz signal generated by 32 kilohertz crystal oscillator 42: a successful comparison indicating that a valid programming signal is being received.

To minimize the occurrence of extraneous noise being detected as a valid signal by digital AM detector circuit 26 the 16 kilohertz signal is used from divide-by-two circuit 44 to count two transitions of the detected programming signal in one cycle of the 16 kilohertz signal before the flip-flops are reset to zero to start the count again. Thus two transactions of the detected programming signal and the 32 kilohertz output of crystal oscillator 42 are to be successfully counted and compared for the digital AM detector circuit 26 to produce a valid output.

The programming signal is then fed into on/off logic circuit 46 and into identification program logic circuit 48. Identification program logic circuit 48 also receives input from on/off logic circuit 46 and 8 bit shift register 28.

On/off logic circuit 46 outputs an "on" signal after successful reception of all the bits of the programming code from digital AM detector circuit 26. As long as an "off" signal is outputted from on/off logic circuit 46 identification program logic circuit 48 loads 8 bit shift register 28 with the incoming programming code, particularly the 7 bit identification code and 1 bit tamper flag. After receiving all of the programming code from digital AM detector circuit 26, on/off logic circuit 46 outputs an "on" signal, enabling identification program logic circuit 48 to reirculate the programming code stored in 8 bit shift register 28, consisting at this time of the 7 bit unique identification code and the 1 bit tamper flag indicator.

Further, on/off logic circuit 46, upon receiving the initial synchronizing or start bit of the programming code, energizes time delay circuit 50 which times the output of on/off logic circuit 46, identification program logic circuit 48, tamper flag logic circuit 52, synchronizing logic 30, and bi-phase encoder 32, enabling the programming code stored in transmitter 10 to be transmitted periodically, particularly every two seconds.

Therefor, the synchronizing or start bit of the programming code is used for synchronizing and starting the timing of transmitter 10, with monitor 14, as will be hereinafter explained. The 1 bit of the start bit must be longer than half a bit period for on/off logic circuit 46 to energize time delay circuit 50. Thereafter on/off logic circuit 46 samples the center of each bit period, outputting an "on" signal after the remaining 7 bit identification code and 1 bit tamper flag have been sampled.

Thus, every two seconds identification program logic circuit 48 is enabled by time delay circuit 50 to input the 7 bit identification code and 1 bit tamper flag from digital AM detector circuit 26, if on/off logic circuit 46 outputs and "off" signal, to 8 bit shift register, or, when on/off logic circuit 46 outputs and "on" signal, identification program logic circuit 48 recirculates the output of 8 bit shift register 28.

At the same time, time delay circuit 50 enables synchronizing logic 30 and bi-phase encoder 32.

Particularly, the output of 8 bit shift register 28, comprising the 7 bit identification code and 1 bit tamper flag, is recombined with the synchronization or start bit at synchronizing logic 30 to form the transmitted code, which, in most cases, is identical to the programming code received. The transmitted code is then encoded at bi-phase encoder 32 and modulated for FM transmission by 16.620 megahertz crystal oscillator 34. The resulting signal is sent to frequency tripler circuit 36, to power amplifier 38 and finally to antenna 12 for transmission.

Antenna 12 in the preferred embodiment is particularly comprised of a loop antenna. To minimize points of poor reception by monitor 14 of the periodically transmitted code, however, antenna 12 can be combined with a wire antenna.

The transmitted code is thus transmitted periodically, every 2 seconds, at 2048 baud. To achieve a duration of transmission of 6 milliseconds the start or synchronizing bit provided at synchronizing logic 30 actually consists of 4 bits—1 bit preceded by three 0 bits. The resulting transmitted code is thus 12 bits long.

Clip 54 is provided on the rear surface of transmitter 10, as best illustrated in FIG. 4 to attach and secure transmitter 10 to an object such as a child.

To safeguard against accidental or forceful dislodgement of transmitter 10 from an object, such as a child, clip 54 is provided with tamper switch 22. The premature opening or breaking of clip 54 causes tamper switch 22 to enable tamper flag logic circuit 52 to change the tamper flag bit located at 56 in 8 bit shift register 28 from zero to one. By timing tamper flag logic circuit 52 with time delay circuit 50 the output of tamper switch 22 is read every two seconds, that is every time transmitter 10 transmits the transmitted code.

It is to be appreciated that by changing the tamper flag bit at 56 in 8 bit shift register 28 from a zero to one, the transmitted programming code changes from the original code programmed. This change will be detected by monitor 14, as outlined hereinbelow.

Figure 5:
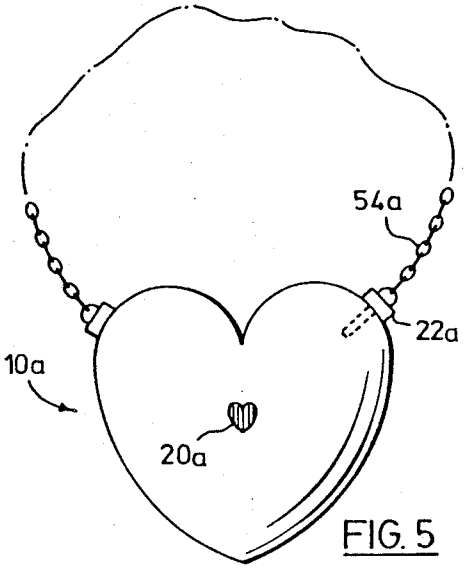
FIG. 5 is a front view of an alternative form of a sample transmitter.

An alternative form for the transmitter is illustrated in FIG. 5 wherein transmitter **10*a* is in the form of a locket. Necklace 54*a* is provided for attaching and securing transmitter 10*a* to an object, particularly a child. Tamper switch 22*a* is provided where necklace 54*a* joins transmitter 10*a*** and operates in the same manner as described hereinbefore.

Transmitter **10*a* also provides exteriorly a conductive surface area 20*a* for receiving programing from monitor 24. Transmitter 10*a* operates identically to transmitter 10** as already outlined.

Monitor 14, as best illustrated in FIG. 1, basically provides means to receive and monitor the periodically transmitted code from transmitter 10, including antenna 16, radio frequency receiver 58, and bi-phase decoder 60, means to identify the received signal, including identification check circuit 62, and identification program unit 64, means to note the presence or absence of an incoming signal from a given transmitter over a set period of time including on/off flag circuits 66, 68, logic timing circuits 70, 72, and counter circuits 74, 76, respectively, and means for providing visual and audio alarms as to the presence or absence of an incoming signal from transmitter 10 including audio logic circuit 78 and liquid crystal display circuit 80; the operation of all these circuits being controlled by monitor control logic circuit 82.

Operator switch 84 in the preferred embodiment illustrated includes three positions, labelled "off", "search", and "guard". The function of each of these positions shall be hereinafter explained.

When operator switch 84 is switched to the "guard" position an on signal is sent to OR-gate 86 switching on 32 kilohertz crystal oscillator 40 energizing divider circuit 88, logic timing circuits 70, 72, and bi-phase decoder 60. The output of divider circuit 88 comprises a 128 hertz signal and a 2 kilohertz signal. The 128 hertz signal is outputted to logic timing circuits 70, 72, bi-phase decoder 60, identification check circuit 62, program logic circuit 90, and monitor control logic circuit 82. The 2 kilohertz signal of divider circuit 88 is outputted to audio logic circuit 78 to provide the appropriate audio warning tone.

At the same time operator switch 84 dispatchs a signal to monitor control logic circuit 82, audio logic circuit 78 and liquid crystal display 80, indicating that monitor 14 is in the "guard" mode.

The signal outputted by 32 kilohertz crystal oscillator 40, once powered on, enables logic timing circuits 70, 72, to be energized. Logic timing circuits 70, 72, are set one second out of synchronization with respect to one another, so that the signals outputted by logic timing circuits 70, 72, to monitor control logic circuit 82 are 1 second apart, enabling monitor control logic circuit 82 to determine which transmitter 10 is transmitting the transmitted code at that time.

The synchronizing of transmitter 10 to logic timing circuits 70, 72 shall be described below with respect to the "search" mode of monitor 14.

The outputting of "on" or "off" signals from on/off flag and control circuits 66, 68 shall also be described below with respect to the "search" and "off" modes of monitor 14. The following discussion with respect to the "guard" mode shall assume that these circuits are "on" - indicating to monitor control logic circuit 82 that, in the preferred embodiment, two transmitters have been programmed and are transmitting the transmitted code periodically, every two seconds, one second out synchronization.

Basically then, monitor control logic circuit 82, upon receiving an appropriate signal from logic timing circuits 70 or 72 that a particular transmitter 10 shall be transmitting the transmitted code, outputs a signal energizing radio frequency receiver 58, bi-phase decoder 60, and identification check circuit 62.

Particularly, logic timing circuits 70, 72 are timed such that monitor control logic circuit 82 energizes radio frequency receiver 58 1/32 of a second before the expected transmission from a given transmitter 10, and maintains the energization of same for 1/16 of a second.

The incoming signal from transmitter 10 is then received and demodulated through radio frequency receiver 58, including antenna 16, and bi-phase decoder 60. The range of radio frequency receiver 58 can be adjusted by slide switch 92 which adjusts the gain of radio frequency receiver 58. Therefor, the distance that a transmitter 10 can be away from monitor 14 in order that a transmitted signal be received can be adjusted. It is to be appreciated that due to the nature of transmitter antenna 12 and monitor antenna 16 and any intervening obstacles between monitor 14 and transmitter 10 the distance that transmitter 10 can be from monitor 14 is never a fixed measurement, but rather a variable range. For example, in the preferred embodiment a high setting on slide switch 92 would set the distance that transmitter 10 can be away from monitor 14 up to 1000 feet. Medium to low settings will set the range at various intermediate points from monitor 14.

Bi-phase decoder 60 then outputs the received demodulated transmitted code to identification check circuit 62. Here the 7 bit identification code of the received transmitted code is compared to the stored 7 bit identification code from identification program unit 64. It should be noted that identification unit 64 is programmed with the 7 bit identification code at the time of manufacture, the identification code for the system being hard wired by means of jumper wires into identification program unit 64. Therefor, each monitor 14 programs its associated transmitters 10 with a unique 7 bit programming code.

At the same time the last bit of the transmitted code, being the tamper flag is read into a latch contained within identification check circuit 62.

Upon favorable comparison between the transmitted code and the programmed 7 bit unique identification code from identification program unit 64, and upon the tamper flag latch remaining unchanged, identification check circuit 62 transmits a valid comparison signal to monitor control logic circuit 82.

Monitor control logic circuit 82 then transmits the valid comparison signal to appropriate logic timing circuit 70 or 72, depending upon which one is currently energized. On/off flag circuits 66, 68 indicate to monitor control logic circuit 82 the number of tranmitters currently activated and programmed (in the preferred embodiment this is two) while timing circuits 70, 72 indicate the monitor control logic circuit 82 which transmitter 10 is transmitting the coded radio frequency signal at that time. Upon evaluating all of these inputs monitor control logic circuit 82 determines which logic timing circuit, either 70 or 72, the valid comparison signal is to be transmitted.

Upon receiving the valid comparison signal from monitor control logic circuit 82 logic timing circuit 70 or 72 transmits an appropriate signal to corresponding counter 74 or 76, respectively, resetting same.

If an invalid comparison signal is received by either logic timing circuit 70 or 72 from monitor control logic circuit 82, logic timing circuit 70 or 72 transmits an appropriate signal to corresponding counter 74 or 76 counting off one unsuccessful transmission from that transmitter 10. Each successive unsuccessful transmission from transmitter 10 causes a further count to be recorded by corresponding counter 74 or 76. In the preferred embodiment counters 74 and 76 are set so that three consecutive transmission times are missed before counter 74 or 76 outputs a signal to audio warning circuit 78 energizing same, and liquid crystal display 80, to indicate visually which transmitter 10 failed to transmit or transmitted an invalid transmitted code (as in the case of tamper flag bit at 56 in 8 bit shift register 28 of transmitter 10 being changed), so that the appropriate warnings are indicated.

By maintaining the tamper flag in a latch identification check circuit 62 of monitor 14 is able to tansmit an invalid comparison signal indicating that only the tamper flag bit has changed, providing appropriate audio or visual warning to this effect, as described hereinbelow under the heading "Operation".

If, while during the count by counters 74 or 76 of failed or invalid transmitted signals from transmitter 10, or during the appropriate warnings from audio warning circuit 78 and liquid crystal display 80, indicating that a transmitter 10 has failed to transmit or has transmitted an invalid code at least three consecutive times, a valid code is received, then logic timing circuits 70 or 72 upon receiving the valid comparison signal from monitor control logic circuit 82, transmit an appropriate signal to corresponding counters 74 or 76, resetting same. Upon resetting counters 74 or 76 any audio or visual warning indicated by audio warning circuit 78 and liquid crystal display 80 shall cease.

The operation of monitor 14 when operator switch 84 is in the "search" mode is similar to that as in the "guard" mode. In "search" mode, however, audio warning circuit 78 is enabled to give the appropriate audio indication upon reception of a successful signal by monitor 14 from transmitter 10.

Logic timing circuits 70 or 72 upon receiving a valid comparison signal from monitor control logic circuit 82 transmit an appropriate signal to audio logic circuit 78 and liquid crystal display 80, for indicating successful reception of same, as well as reset counters 74 or 76. When counters 74 or 76 have counted three consecutive failed transmissions, either by failing to receive the transmitted signal from transmitter 10 or receiving an invalid programming code, an appropriate signal is transmitted from counters 74 or 76 to audio warning circuit 78, ceasing the audio tone, which in the "search" mode indicates unsuccessful reception of a valid signal from a given transmitter 10.

Further, when monitor 14 is in "search" mode, monitor 14 is able to program transmitter 10 with the programming code, consisting of the 7 bit unique identification code, the tamper flag bit, and the start or synchronizing bit.

At the same time that radio frequency receiver 58 is energized by monitor control logic circuit 82 through logic timing circuits 70 or 72 to receive a transmitted signal from transmitter 10, the 7 bit unique identification code from identification program unit 64 is transmitted to program logic circuit 90 for transmission, together with the start or synchronizing bit and 1 bit tamper flag, by local capacitive coupling through conductive surface area 18 on monitor 14 to conduvtive surface area 20 on transmitter 10, when same are brought together in interactive engagement.

Therefore, in the "search" mode, monitor control logic circuit 82, upon receiving an indication from either logic timing circuit 70 or 72 to energize radio frequency receiver 58, instructs identification check circuit 62, bi-phase decoder 60 and program logic circuit 90 to transmit the programming code to transmitter 10. Particularly, the 7 bit unique identification code is identification program unit 64 is inputted to identification check circuit 62 which, through two-way communication line 94, sends the code to bi-phase decoder 60 and onwards to program logic circuit 90. The final programming code is then transmitted through local capacitive coupling to transmitter 10 as hereinbefore described.

It is to be appreciated that by having monitor control circuit 82 energize program logic circuit 90, bi-phase decoder 60, and identification check circuit 62 to transmit the programming code upon receiving an appropriate energizing signal from logic timing circuit 70 or 72, ensures that transmitter 10 receives the synchronization bit, energizing time delay circuit 50, and ultimately causing transmitter 10 to transmit the transmitted code every two seconds in synchronization with the energization of radio frequency receiver 59 of monitor 14.

As hereinbefore explained transmitter 10, upon receiving the complete programming code, immediately begins transmitting and continues thereafter every two seconds.

Upon receiving the transmitted code from transmitter 10, and upon receiving a valid comparison signal from identification check circuit 62, monitor control logic circuit 82 shall, in addition to transmitting a valid comparison signal to either logic timing circuit 70 or 72, program logic circuit 90 to turn "off" and shall instruct the correspoonding on/off flag circuits 66 or 68 to turn "on". On/off flag circuits 66, 68 then provide input to monitor control logic circuit 82 informing same as to the number of transmitters that have been energized and programmed.

To minimize the occurrence of an invalid programming code being programed to transmitter 10, program logic circuit 90 transmits immediately after the programming code a series of "off" pulses, as will be hereinafter described for the "off" mode. If a valid programming code is received by receiver 58 of monitor 14 from transmitter 10 being programmed, then monitor control logic circuit 82 will turn "off" program logic circuit 90 discontinuing the transmission of the "off" pulses. If, however, transmitter 10 is programmed incorrectly identification check circuit 62 upon receiving and comparing the demodulated transmitted code from transmitter 10 will transmit an invalid comparison signal. Hence monitor control logic circuit 82 will not turn "off" program logic circuit 90, and the "off" pulses will be fed into transmitter 10, turning same off. The next time logic timing circuit 70 or 72 energize monitor control logic circuit 82 the programming process shall be repeated until the transmitted code from transmitter 10 generates a valid comparison signal from identification check circuit 62, indicating reception of a correct programming code.

When operator swith 84 is turned to the "off" mode an off signal from operator switch 84 is entered to OR-gate 86. However, either or both on/off flag circuits 66 or 68 will still be transmitting valid "on" signals for their corresponding transmitters 10.

In the "off" mode monitor control logic circuit 82 instructs program logic circuit 90 to transmit "off" signals consisting of a series of 32 kilohertz clock bursts, to transmitter 10, again by local capacitive coupling through conductive surface area 18 on monitor 14 to conductive surface area 20 an transmitter 10, when same are brought together in interactive engagement. The duration of a burst is one quarter of a bit period at 2048 baud. A burst would consist of four 32 kilohertz clocks which is repeated every 1/2048 of a second.

As the duration of the burst is less than half of a bit period on/off logic circuit 46 of tranmsitter 10 outputs an "off" signal, resetting time delay circuit 50. With time delay circuit 50 held in reset, tansmitter 10 is effectively turned off.

Monitor control logic circuit 82 of monitor 14 then receives from identification check circuit 62 an invalid comparison signal and relays same to on/off flag circuit 66 or 68 turning same "off". Once both on/off flag circuits 66 and 68 are turned "off" then OR-gate 89 transmits an "off" signal to 32 kilohertz oscillator 40, effectively turning monitor 14 off.

Operation

In operation, then, operator switch 84 of monitor 14 is first switched from the "off" position to the "search" mode. Monitor 14 is then ready to receive a transmitted radio frequency code from its associated transmitters 10, and more particularly, monitor 14 is now ready to program transmitters 10 with the 7 bit identification code, and 1 bit tamper flag, as described hereinbefore.

In programming a transmitter 10 conductive surface area 20 on transmitter 10 is brought into interactive engagement with conductive surface area 18 on monitor 14 so that the programming code an be fed into transmitter 10 through local capacitive coupling.

Upon successful programming of one transmitter 10, on/off flag circuit 66 of monitor 14 outputs an "on" signal indicating to monitor control circuit 82 that one transmitter 10 has been programmed. Also, an "on" signal is outputted to liquid crystal display 80 so that the appropriate "Unit-On" shall be lit. In this particular example the "Unit 1-On" display 96 shall light up.

Upon receiving a successful transmission from transmitter 10, audio logic circuit 78 shall provide the appropriate tone, every two seconds. Further, liquid crystal display 80 shall, at the same time, provide visual indication of successful reception of transmission through happy face 98.

A second transmitter 10 can then be programmed in a similar manner. On/off flag circuit 68 will then output an "on" signal letting monitor control logic circuit 82 know that two transmitters have been programmed and further having liquid crystal display 80 indicate that a second transmitter has been programmed by the appropriate "Unit 2-On" display 100, being lit, and further, having happy face 102 flashing every two seconds every time a successful signal is received from the second transmitter.

It should be noted that happy faces 98 and 102 will flash one second out of synchronization due to the timing of logic timing circuits 70, 72. Hence, the synchronizing of the two transmitters 10 shall be one second apart.

The transmitters can then be attached by clip 54 or necklace 54*a*, or any other suitable means, to a given object, person or animal, for example a child or a dog.

Switching the monitor to "guard" mode causes audio logic circuit 78 to produce a warning audio signal only upon failure of receiving a given number of consecutive transmitted signals. Note, however, that liquid crystal display 80 causes happy faces 98, 102 to flash every time a successful signal is received from the corresponding transmitter in both "search" and "guard" modes.

Slide switch 92 can be adjusted to set a range defining an area within which transmitters 10 can move freely without setting off an alarm.

Upon moving a transmitter 10 outside the range setting the monitor will fail to receive the transmitted radio frequency signal. After failure of receiving three consecutive transmissions counter circuits 74 or 76 of monitor 14 instruct audio logic circuit 78 to provide the appropriate warning tone, and further, instructs liquid crystal display 80 to flash the "ALERT" indicator 104. Corresponding happy face 98 or 102 to the out of range transmitter 10 ceases flashing and remains lit continuously, indicating which transmitter 10 has gone outside the desired range setting.

It is to be appreciated that audio logic circuit 78 can be programmed to provide differing audio tones for the different transmitters.

It is further to be appreciated that due to the monitor providing audio tones when in the "search" mode that monitor 14 can then be used to locate the missing transmitter.

In particular, in the "search" mode monitor 14 can be moved until an appropriate tone is heard through audio logic circuit 78, indicating that the transmitter in now within the set range. By so reducing the range and continuously locating the transmitter in this manner it is possible to bring the transmitter within an area close enough to monitor 14 so that sighting by visual inspection is readily done.

Further, premature removal of transmitter 10 from the object before same is turned "off" causes tamper switch 22 and tamper flag logic circuit 52 to change the 1 bit tamper flag located at 56 in 8 bit shift register 28. This change is detected by monitor 14 as described hereinbefore and again results in the appropriate audio tone being sound by audio logic circuit 78 and the appropriate happy face 98, 102 remaining continuously lit to indicate which transmitter has become dislodged. Further, liquid crystal display 80 causes the "TAMPER" indicator 106 to commence flashing distinguishing between an alarm for the transmitter going out of range, or the transmitter being tampered with.

Finally, it will be understood that variations or alternatives will be introduced or included to the apparatus described and illustrated by those persons skilled in this field without departing the spirit or scope of the invention defined by the amended claims.

What I claim is:

1. In apparatus for monitoring the presence or absence of a common coded radio frequency signal within a given area, monitoring means including electronic circuit means for receiving said coded radio frequency signal, and at least one transmitting means associated with said monitoring means including electronic circuit means for producing and transmitting said coded radio frequency signal periodically in predetermined spaced apart time intervals; said monitoring means including: electronic circuit means for programming said transmitting means to produce and transmit said coded radio frequency signal in said predetermined spaced apart time intervals; electronic circuit means, including a logic timing circuit, for identifying said coded radio frequency signal received with said associated transmitting means; and electronic circuit means and alarm means for indicating failure of reception of said common coded radio frequency signal.

2. In apparatus for monitoring the presence or absence of a common coded radio frequency signal within a given area, monitoring means including electronic circuit means for receiving said coded radio frequency signal, and a plurality of transmitting means associated with said monitoring means including electronic circuit means for producing and transmitting said coded radio frequency signal periodically in predetermined spaced apart time intervals to one another; said monitoring means including: electronic circuit means for programming said plurality of transmitting means to produce and transmit said coded radio frequency signal in said predetermined spaced apart time intervals to one another; electronic circuit means, including a logic timing circuit, for identifying said coded radio frequency signal received with one of said plurality of transmitting means; and electronic circuit means and alarm means for indicating failure of reception of said common coded radio frequency signal.

3. Apparatus according to claim 1 or 2 wherein said monitoring means includes storing means containing a coded signal, and verifying electronic circuit means including a check circuit for comparing said common coded radio frequency signal received with said coded signal contained in said storing means.

4. Apparatus according to claim 1 or 2 wherein said monitoring means includes storing means containing a coded signal, and electronic circuit means for transmitting said coded signal from said storing means of said monitoring means to said producing electronic circuit means of said transmitting means.

5. Apparatus according to claims 1 or 2 wherein said electronic circuit means and alarm means of said monitoring means includes a counter circuit for counting successive failures of reception of said common coded radio frequency signal for a given transmitting means and for activating said alarm means indicating failure of reception of said common coded radio frequency signal after a given number of counts.

6. Apparatus according to claims 1 or 2 wherein said monitoring means includes electronic circuit means for indicating successful reception of said common coded radio frequency signal.

7. In apparatus for monitoring the presence or absence of at least one object within a given area, monitoring means including electronic circuit means, including antenna and receiver, for receiving a common transmitted coded radio frequency signal, and at least one transmitting means associated with said monitoring means including means for attachment to said object and including electronic circuit means for producing said coded radio frequency signal periodically in predetermined spaced apart time intervals, and electronic circuit means for transmitting said signal produced; said monitoring means including: electronic circuit means for programming said transmitting means to produce and transmit said coded radio frequency signal in said predetermined spaced apart time intervals; electronic circuit means, including a logic timing circuit, for identifying said coded radio frequency signal received with said associated transmitting means, storing means containing a coded signal; verifying electronic circuit means including a check circuit for comparing said coded radio frequency signal received with said coded signal stored, and electronic circuit means and alarm means for indicating failure of reception of said common coded radio frequency signal.

8. In apparatus for monitoring the presence or absence of a plurality of objects within a given area, monitoring means including electronic circuit means, including antenna and receiver, for receiving a common transmitted coded radio frequency signal, and a plurality of transmitting means associated with said monitoring means including means for attachment to said objects and including electronic circuit means for producing said coded radio frequency signal periodically in predetermined spaced apart time intervals to one another, and electronic circuit means for transmitting said signal produced; said monitoring means including: electronic circuit means for programming said plurality of transmitting means to produce and transmit said coded radio frequency signal in said predetermined spaced apart time intervals to one another; electronic circuit means, including a logic timing circuit, for identifying said coded radio frequency signal received with one of said plurality of transmitting means; storing means containing a coded signal; verifying electronic circuit means including a check circuit for comparing said coded radio frequency signal received with said coded signal stored; and electronic circuit means and alarm means for indicating failure of reception of said common coded radio frequency signal.

9. Apparatus according to claims 7 or 8 wherein said means for attaching said transmitting means to said object includes tamper switch and logic circuit for altering said common coded radio frequency signal produced and transmitted upon premature removal of said transmitting means from said object.

10. Apparatus according to claims 7 or 8 wherein said monitoring means includes electronic circuit means for transmitting said coded signal contained in said storing means of said monitoring means from said storing means to said producing electronic circuit means of said transmitting means.

11. Apparatus according to claims 7 or 8 wherein said electronic circuit means and alarm means of said monitoring means includes a counter circuit for counting successive failures of reception of said common coded radio frequency signal for a given transmitting means and for activating said alarm means indicating failure of reception of said common coded radio frequency signal after a given number of counts.

12. Apparatus according to claims 7 or 8 wherein said common coded radio frequency signal transmitted includes a digital identification code.

13. Apparatus according to claims 7 or 8 wherein said common coded radio frequency signal transmitted includes a digital identification code, said producing electronic circuit means of said transmitting means includes a shift register for storing said digital identification code and outputting same to said transmitting electronic circuit means and a logic circuit for recirculating said digital identification code outputted from said shift register back into said shift register, and said transmitting electronic circuit means includes means for encoding and modulating said digital identification code for transmission.

14. Apparatus according to claims 7 or 8 wherein said common coded frequency signal transmitted includes a digital identification code, said producing electronic circuit means of said transmitting means includes a shift register for storing said digital identification code and outputting same to said transmitting electronic circuit means and a logic circuit for recirculating said digital identification code outputted from said shift register back into said shift register, and said transmitting electronic circuit means includes means for encoding and modulating said digital identification code for transmission, said receiver of said monitoring means includes means for demodulating and decoding said received digital identification code, and said coded signal contained in said storing means of said monitoring means comprises a digital code substantially identical to said digital identification code stored in said shift register of said transmitting means.

15. Apparatus according to claims 7 or 8 wherein said monitoring means includes electronic circuit means including audio logic circuit and liquid crystal display for indicating successful reception of said common coded radio frequency signal.

16. In electronic alarm apparatus for monitoring the presence or absence of at least one object within a given area, monitoring means including an antenna and receiver for receiving, demodulating and decoding a common transmitted radio frequency signal including a digital identification code, and at least one transmitting means associated with said monitoring means for producing and transmitting said radio frequency signal periodically in predetermined spaced apart time intervals; said transmitting means including means for attachment to said object and including a shift register for storing said digital identification code and outputting same to a transmitting electronic circuit and a logic circuit for recirculating said digital identification code outputted from said shift register back into said shift register, said transmitting electronic circuit including means for modulating and encoding said digital identification code; said monitoring means including: electronic circuit means for programming said transmitting means to produce and transmit said coded radio frequency signal in said predetermined spaced apart time intervals; electronic circuit means, including a logic timing circuit, for identifying said radio frequency signal received with said associated transmitting means; storing means containing a coded signal comprised of a digital code substantially identical to said digital identification code stored in said shift register of said transmitting means; verifying electronic circuit means including a check circuit for comparing said radio frequency signal received, including the digital identification code, with said coded signal stored; and electronic circuit and alarm means including audio logic circuit and liquid crystal display for indicating failure of reception of said common radio frequency signal.

17. In electronic alarm apparatus for monitoring the presence or absence of a plurality of objects within a given area, monitoring means including an antenna and receiver for receiving, demodulating, and decoding a common transmitted radio frequency signal including a digital identification code, and a plurality of transmitting means associated with said monitoring means for producing and transmitting said radio frequency signal periodically in predetermined spaced apart time intervals; said transmitting means including means for attachment to said object and including a shift register for storing said digital identification code and outputting same to a transmitting electronic circuit and a logic circuit for recirculating said digital identification code outputted from said shift register back into said shift register, said transmitting electronic circuit including means for modulating and encoding said digital identification code; said monitoring means including: electronic circuit for programming said plurality of transmitting means to produce and transmit said coded radio frequency signal in said predetermined spaced apart time intervals to one another; electronic circuit means, including a logic timing circuit, for identifying said radio frequency signal received with one of said plurality of transmitting means; storing mean containing a coded signal comprised of a digital code substantially identical to said digital identification code stored in said shift register of said transmitting means; verifying electronic circuit means including a check circuit for comparing said radio frequency signal received, including the digital identification code, with said code signal stored; and electronic circuit and alarm means including audio logic circuit and liquid crystal display for indicating failure of reception of said common radio frequency signal.

18. Apparatus according to claims 16 or 17 wherein said means for attaching said transmitting means to said object includes tamper switch and logic circuit for altering said digital identification code transmitted as a radio frequency signal upon premature removal of said transmitting means from said object.

19. Apparatus according to claims 16 or 17 wherein said monitoring means includes an electronic circuit including a program logic circuit, and said transmitting means includes an electronic circuit including a capacitive coupling amplifier, detector circuit and on/off logic circuit, for transmitting said coded signal contained in said storing means of said monitoring means from said storing means to said shfit register of said transmitting means.

20. Apparatus according to claims 16 or 17 wherein said electronic circuit and alarm means of said monitoring means includes a counter circuit for counting successive failures of reception of said radio common frequency signal for a given transmitting means and for activating said alarm means indicating failure of reception of said common radio frequency signal after a given number of counts.

21. Apparatus according to claims 16 or 17 wherein said monitoring means includes an electronic circuit including audio logic circuit and liquid crystal display for indicating successful reception of said common radio frequency signal.

* * * * *